United States Patent [19]

Bailey

[11] 4,352,783

[45] Oct. 5, 1982

[54] APPARATUS FOR MOUNTING A PLURALITY OF CATALYTIC ELEMENTS FOR TREATING LARGE VOLUMES OF EXHAUST GASES

[75] Inventor: Charles H. Bailey, Mt. Prospect, Ill.

[73] Assignee: UOP Inc., Des Plaines, Ill.

[21] Appl. No.: 272,157

[22] Filed: Jun. 10, 1981

[51] Int. Cl.[3] ..... B01D 53/36; F01N 3/28; F01N 7/16

[52] U.S. Cl. ..... 422/179; 55/DIG. 30; 422/180; 422/311

[58] Field of Search ..... 422/171, 179, 180, 197, 422/221, 222, 34; 60/299; 55/484, 494, DIG. 30, 480, 493

[56] References Cited

U.S. PATENT DOCUMENTS

| | | | |
|---|---|---|---|
| 3,597,165 | 8/1971 | Keith et al. | 422/179 |
| 3,838,977 | 10/1974 | Warren | 422/179 |
| 3,852,042 | 12/1974 | Wagner | 422/179 |
| 4,250,146 | 2/1981 | Bailey | 422/179 |
| 4,269,807 | 5/1981 | Bailey et al. | 422/179 |

FOREIGN PATENT DOCUMENTS

| | | | |
|---|---|---|---|
| 2920604 | 11/1979 | Fed. Rep. of Germany | 422/179 |

*Primary Examiner*—Bradley Garris

*Attorney, Agent, or Firm*—James R. Hoatson, Jr.; Barry L. Clark; William H. Page, II

[57] ABSTRACT

A plurality of monolithic catalyst support elements are mounted in parallel in a plurality of recessed retaining portions of a bulkhead member separating an inlet plenum from an outlet plenum. The catalyst support elements are each compressed at one end into contact with a gasket member in each retaining portion by force applying means positioned so as to contact the other end of a plurality of catalyst support elements at one time. In one embodiment, the various elements of the apparatus are formed of materials having different coefficients of expansion and related lengths so as to maintain compression without the use of specific spring elements. Other embodiments use springs to compress either a single catalyst support element at a time or several at once.

6 Claims, 6 Drawing Figures

APPARATUS FOR MOUNTING A PLURALITY OF CATALYTIC ELEMENTS FOR TREATING LARGE VOLUMES OF EXHAUST GASES

BACKGROUND OF THE INVENTION

The invention relates to catalytic converters for treating exhaust gases, and especially to converters capable of handling large gas volume applications such as large stationary engines. It is economically desirable, due to the relatively small numbers of large engines made, to utilize ceramic monolithic catalyst elements of the type developed and extensively tested for automotive use. However, a 2000 HP engine may require 100 or more of such automotive type elements. Since the single element mounting structures used for automotive applications would be extremely expensive, there would appear to be a need for a good economical mounting system for mounting a plurality of ceramic elements in a large converter housing. Such a mounting system should be light and inexpensive to fabricate, able to prevent bypass leakage designed for easy field change of the catalyst elements, and durable through many temperature cycles even though the ceramic and metal parts have widely different coefficients of thermal expansion. One system which eliminates the converter housing and the metal mesh blanket which typically surrounds the ceramic element is disclosed in my U.S. Pat. No. 4,250,146 which is assigned to a common assignee. However, the patented system is most useful for mounting a single element in that it utilizes at least three springs and at least three fasteners to bias a pair of end support elements towards the ceramic catalyst support element and towards each other. It would be quite cumbersome to adapt such a system to a large converter installation although far less costly than the use of a plurality of housed elements.

SUMMARY

It is among the objects of the present invention to provide an apparatus for effectively and economically mounting a plurality of cylindrical monolithic catalyst support elements closely adjacent to each other for parallel flow of exhaust gases therethrough. In each of several embodiments of the invention, a plurality of catalyst support elements are each mounted with one end, preferably the outlet end, in a gasketed recess surrounding an aperture in a bulkhead member which separates an outlet plenum from an inlet plenum. The opposite ends of the elements are engaged by end support members, preferably of a very open dome construction so as to not block the flow of gases into the elements. A compressive force is applied to at least two of the end support members at once, preferably at their centers, and on the axis of the support elements. The force is applied by a transverse force applying member which is preferably supported near one end of a boltlike member which has its other end positioned on the opposite side of the bulkhead member. In one embodiment, the various elements which cooperate to carry the compressive force are sized in length and formed of materials having specific temperature expansion properties which will coact with each other to ensure good retention of the support elements—without the need for additional springs. In another embodiment, a single spring positioned on the bolt on the side of the force applying member which is remote from the support elements permits the force applying member to rock and apply equal force to two or three support elements which may be somewhat uneven in length. In yet another embodiment, a spring is positioned between each support element and the force applying member, thus permitting any number of support elements to be compressed at one time. In each of the embodiments, a sealing means is preferably provided between the catalyst support element and the recess in the bulkhead member. Typically, this seal can comprise a ring of wire mesh material. However, where it is necessary or desirable to provide maximum sealing against bypass leakage around the catalyst support, the recesses in the bulkhead member may be made of a substantial depth. An elongated strip of metal mesh impregnated with a continuous band of fiber containing intumescent paste material would then be positioned in the recess to fill the space surrounding the support element. The use of such material for bypass sealing is disclosed in co-pending application Ser. No. 86,990, filed Oct. 22, 1979, now U.S. Pat. No. 4,269,807, the disclosure of which is herein incorporated by reference.

DESCRIPTION OF THE PREFERRED EMBODIMENTS

Figure 1:
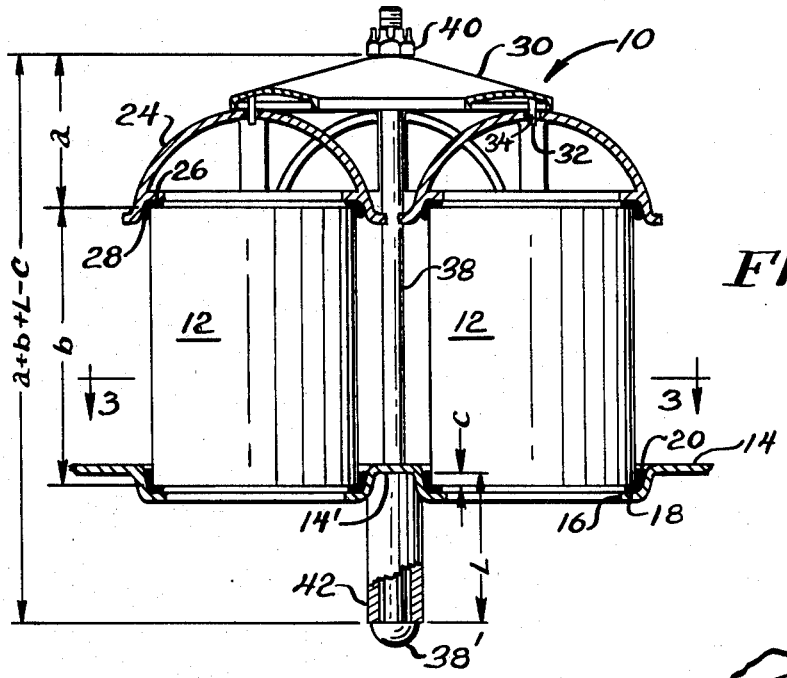
FIG. 1 is a side sectional view of a group of retained catalyst support members taken on line 1—1 of FIG. 2.
Figure 2:
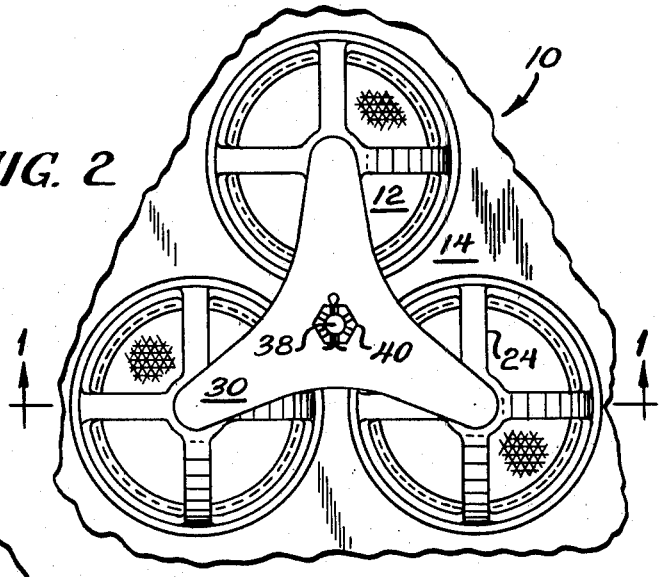
FIG. 2 is a top view of the retained support members shown in FIG. 1.
Figure 3:
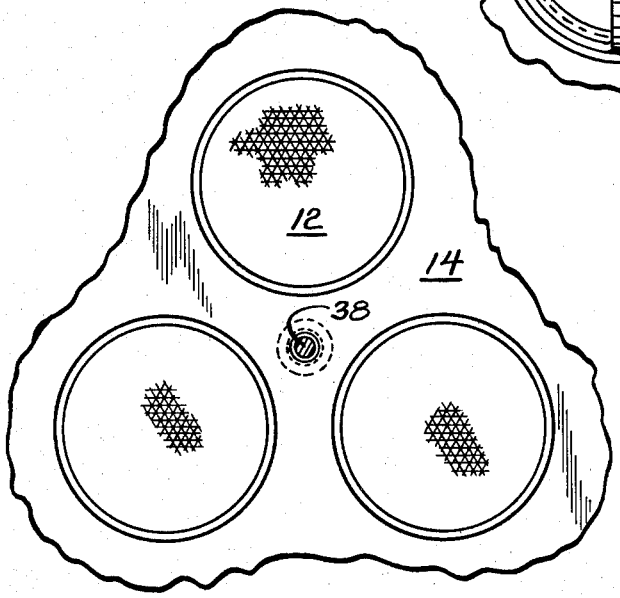
FIG. 3 is a section taken on line 3—3 of FIG. 1.
Figure 4:
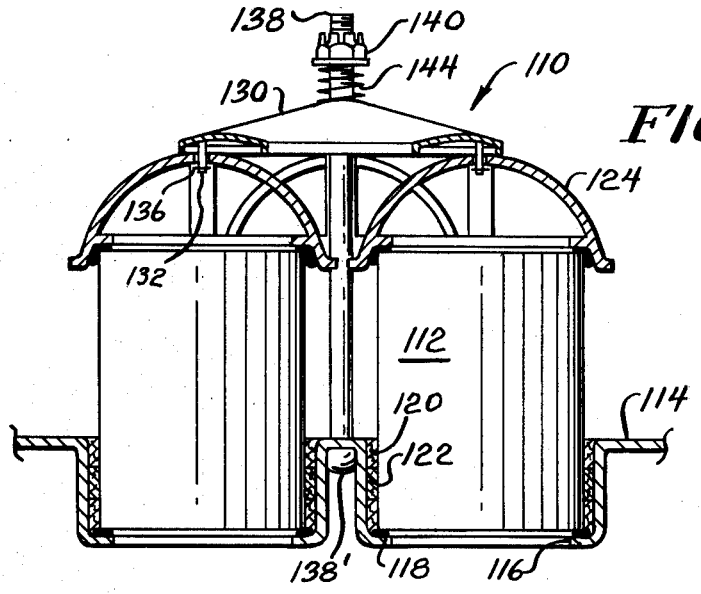
FIG. 4 is a side sectional view similar to FIG. 1 but showing a modified assembly of elements for retaining the support members plus a sealing means for preventing bypass leakage.
Figure 5:
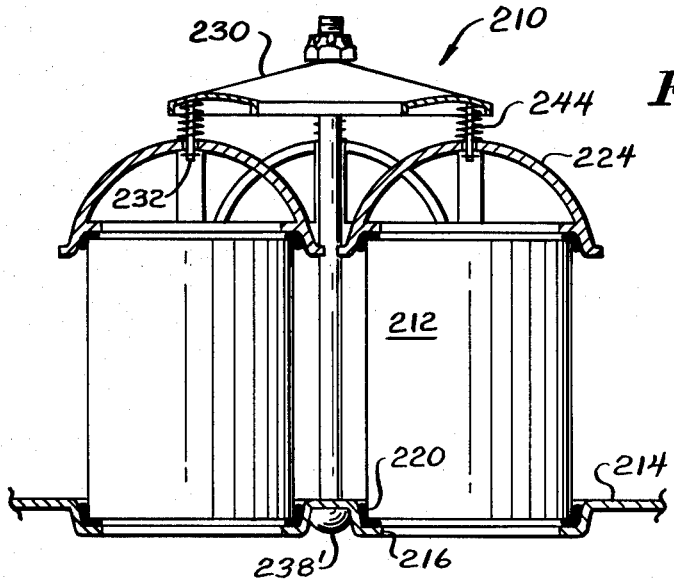
FIG. 5 is a side sectional view similar to FIG. 1 but showing a further modified assembly of elements for retaining the support members.

FIGS. 1 through 3 illustrate a first embodiment of my multiple catalyst element support assembly which is indicated generally at 10. Assuming that the axially channeled ceramic monolithic catalyst elements 12 are usually not of exactly uniform length, the assembly 10 includes only two or three of the elements 12 in order to assure that even holding pressure can be applied to all. The elements 12 are mounted in contact with a metal bulkhead member 14 which would divide the inlet and outlet plenums of a catalytic converter housing. The housing is not shown in FIG. 1, but could be identical to the housing 350 shown in FIG. 6. The elements 12 are mounted so as to overlie the apertures 16 with their edges at their lower end being retained by the recessed retaining portions 18 of the bulkhead member 14 which are formed by bending up wall portions from the material of the member 14 or by welding similarly shaped portions to the member 14. To provide sealing and prevent damage to the brittle ceramic construction of the elements 12, a conventional wire rope sealing ring 20 is placed in the recess 18. A downward pressure is applied to the ceramic elements by dome-shaped end support members 24. The members 24 include a recessed internal surface 26 which retains the upper end of the monolith elements and engages the same through the medium of a gasket or sealing ring 28 which may be similar to the sealing ring 20. The support members 24 are each engaged by a transverse force applying member 30 which overlies the members 24 and which is preferably mounted to the members 24 by means of pins 32 which pass through apertures 34 in the members 24. As shown in FIGS. 4 and 5, the members 30 and 24 may constitute a single subassembly by use of retaining pins such as the pins 136 shown in FIG. 4. Such retaining pins facilitate the installation of the support assembly 10. The force which holds the assembly 10 together is provided by the bolt 38 and nut 40 with the nut being preferably tightened to about 30-50 footpounds of torque. The assembly 10 must be capable of withstanding considerable thermal expansion during use in an engine environment where its temperature can cycle over a large range from room temperature to a design temperature of 1100° F. or higher. To accommodate this temperature range and assure that the catalyst elements will be firmly held at all points within the temperature range, various elements of the assembly 10 may be made of different materials. A spacer tube 42 is provided in order to match the expansion of the bolt 38 to the members 12, 24, 30 and 14. Depending upon the materials selected for the various elements of the assembly, the length "L" of the spacer tube 42 could vary over a substantial range. For example, if the catalyst element 12 is made of a ceramic such as Corning Celcor EX-20 having an expansion coefficient $C_c=0.44\times10^{-6}$ in/in/°F. and if the other materials of the assembly are selected from a group of metals comprising Type 416 stainless steel ($C_{416}=6.47\times10^{-6}$ in/in/°F.), Type 304 stainless steel ($C_{304}=10.21\times10^{-6}$ in/in/°F.), and Moly Alloy ($C_{MA}=3.23\times10^{-6}$ in/in/°F.), the length "L" of the spacer tube or compensator 42 can be calculated as in the following examples. In each example, the ceramic element 12 is assumed to have a height "b" of 5 in., the members 24 and 30 are assumed to have a combined height "a" of 3 in., and the offset portion of the bulkhead member 14 between the recess 18 and the main planar surface is assumed to have a height "c" of 0.5". The effective length of the bolt 38 is then equal to "a+b+L−c". As shown in FIG. 1, the dimension "c" appears shorter than the height of the offset by the height of the sealing ring 20. However, the thickness of the sealing ring 20 is exaggerated for clarity and, in actuality, the ring 20 is considerably compressed.

EXAMPLE I

Assuming that elements 24, 30 and 42 are made of Type 304 stainless steel and bulkhead 14 and bolt 38 are made of Type 416 stainless steel, the length "L" of the compensator 42 can be calculated to be 3.95 in. by the equation:

$$5\times C_c+3\times C_{304}=(7.5+L)\times C_{416}-L\times C_{304}+0.5\times C_{416}$$

EXAMPLE II

Assuming that elements 24, 30 and 14 are made of Type 416 stainless steel, bolt 38 is made of Moly Alloy, and compensator 42 is made of Type 304 stainless steel, the length "L" of the compensator 42 can be calculated to be 0.82 in. by the equation:

$$5\times C_c+3\times C_{416}=(7.5+L)\times C_{MA}-L\times C_{304}+0.5\times C_{416}$$

FIG. 4 illustrates a modified support assembly 110 having elements 112, 114, 116, 118, 124, 130, 132, 138, 138' and 140 which correspond to the similarly numbered elements 12–40 in FIG. 1. The assembly 110 differs from the assembly 10 mainly in that it utilizes a spring 144 to force the members 130, 124 and 112 into contact with the bottom of the recess 118. The spring contacts the top of member 130 and thus permits the member 130 to pivot slightly as necessary to distribute the retaining force equally to the three elements 112 which may differ slightly in length. FIG. 4 also illustrates a recess 118 which is much deeper than shown in FIG. 1 to accommodate an annular strip of wire mesh material 120 which preferably includes a circumferential band of intumescent, ceramic fiber-filled paste material along at least a portion of its axial length. The intumescent material expands when first heated and provides an excellent seal against bypass leakage.

FIG. 5 illustrates an additional modified support assembly 210 having elements 212, 214, 216, 220, 224, 230, 232, 238' which correspond to the similarly numbered elements 12–38' in FIG. 1. The assembly 210 differs from FIG. 4 mainly in that a spring 244 is provided above each of the members 224. By providing separate springs for compressing each catalyst element 212, it is possible for the force-applying element 230 to be formed so as to contact more than three catalyst elements since the element 230 would not have to tilt and physically engage each support member 224.

Figure 6:
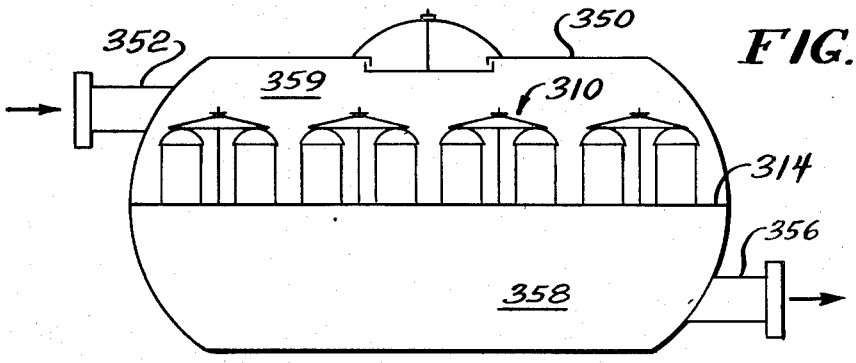
FIG. 6 is a generally schematic view of a large catalytic converter incorporating the invention.

FIG. 6 is a generally schematic view that is intended to show a typical housing 350 in which the various embodiments of FIGS. 1–5 might be mounted to form an exhaust treatment assembly. The housing 350 includes an inlet pipe 352, an outlet pipe 356 and a bulkhead plate 314 which divides the interior of the housing into an inlet plenum 359 and an outlet plenum 358. The support assembly 310 is meant to represent any of the various assemblies 10, 110 or 210 or combinations thereof.

I claim as my invention:

1. An exhaust treatment assembly for catalytically converting large volumes of gases comprising a large chamber having an inlet plenum, an outlet plenum and a bulkhead member separating the plenums, said bulkhead member containing a plurality of apertures and walled portions surrounding each aperture, each of said walled portions being concentric with its associated aperture and spaced radially therefrom so as to form an annular recess around each aperture, gasket means in said recesses and an axially channeled ceramic monolithic catalyst element having a first end positioned in each recess, a metallic end support member in retaining contact with the opposite end of each catalyst element, an axially transverse metallic force applying member arranged and constructed to apply an axial compression force to a plurality of end support members at one time, said end support member being of generally open construction to allow the free flow of gases therethrough, but having at least one contact portion for receiving a compression force from a portion of said axially transverse metallic force applying member and an assembly comprising a metallic nut and bolt which passes through the bulkhead member for transmitting axial compression forces applied by said force applying member to said end support members.

2. The exhaust treatment assembly of Claim 1 wherein means are provided for insuring that axial compression forces will be applied to said plurality of end support members throughout an extended temperature range despite the fact that the ceramic monolith catalyst elements and the metallic members which retain said elements in the recesses in the bulkhead member have substantially different temperature coefficients of expansion.

3. The exhaust treatment assembly of claim 2 wherein said bolt has one end which extends beyond the bulkhead member and is spaced therefrom by a tubular compensator member which surrounds the bolt and transmits the loading from its said one end to the bulkhead member, said compensator member being formed of a metal having a different expansion coefficient than the bolt.

4. The exhaust treatment assembly of claim 2 wherein said means comprises spring means.

5. The exhaust treatment assembly of claim 4 wherein said spring means comprises a compression spring between an end of the bolt and nut asembly and the force applying member.

6. The exhaust treatment assembly of claim 4 wherein said spring means comprises a compression spring between said force applying member and each of said end support members.

* * * * *